United States Patent [19]

Kline

[11] 4,116,204

[45] Sep. 26, 1978

[54] COLLAPSIBLE TELESCOPIC WATER PIPE

[76] Inventor: James E. Kline, Box 1455-R.D. 4, Linglestown, Pa. 17112

[21] Appl. No.: 741,514

[22] Filed: Nov. 15, 1976

[51] Int. Cl.[2] ..... A24F 1/14; A24F 1/30

[52] U.S. Cl. ..... 131/173; 131/198 R; 220/8

[58] Field of Search ..... 131/173, 198; 220/8

[56] References Cited

U.S. PATENT DOCUMENTS

| | | | |
|---|---|---|---|
| 296,902 | 4/1884 | Wirz | 220/8 |
| 1,647,210 | 11/1927 | Bryans | 220/8 X |
| 3,872,872 | 3/1975 | Kahler | 131/173 |
| 4,031,905 | 6/1977 | Dunn | 131/173 |
| 4,036,240 | 7/1977 | Murry, Jr. | 131/173 |

*Primary Examiner*—Stephen C. Pellegrino
*Attorney, Agent, or Firm*—Philip D. Freedman

[57] ABSTRACT

A pipe for consumption of tobacco and other smokable substances, comprises a collapsible, telescopic body in the shape of a truncated cone, closed at its base and open at its narrow end to form a mouthpiece, the sidewall of the body having a first carburetor hole and second stem hole; a stem inserted into the body through the second hole and extending downwardly toward the base of the body and a bowl attached to the exterior end of the stem for the holding of the smokable substance.

5 Claims, 3 Drawing Figures

(LID REMOVED)

COLLAPSIBLE TELESCOPIC WATER PIPE

The East Indian smoking apparatus commonly termed a "hookah" is a well-known smoking device as are other devices that incorporate a vessel which may be supplied with water or other liquid. Franks, U.S. Pat. No. 44,414, discloses such a pipe consisting of a stem and bowl arranged in such a manner so that the bowl may be adjusted relative to the stem or the stem may be adjusted relative to the bowl. The object of the Franks invention is to permit the tobacco holder attached to the bowl to be adjusted with respect to the stem so that as the tobacco burns downwardly the relationship of the elements of the device may be adjusted so that the lateral holes of the stem may be kept just below the burning surface of the tobacco. This device would prevent having smoke drawn downwardly through the mass of tobacco.

Such devices as the hookah or the device shown in the Franks patent are advantageous in that by use of a liquid holding bowl the smoke may be cooled and cleaned to become more agreeable to the user. Because of the requirement that a bowl be provided, such devices usually are rather large and bulky and may be used only in the home of the smoker.

It is an object of the present invention to provide a device which utilizes all the advantages of a liquid containing bowl-type device. The particular advantage, however, of the present invention over the prior art is that the device which is the subject of this invention is collapsible and transportable. Therefore, the device may be carried with the smoker outside of the home and may be used wherever he would desire.

The advantages, as described, of the present invention are achieved by the particular collapsible, telescopic body which is a feature of the present invention. It is a further feature of the present invention that the telescopic body is formed in the shape of a truncated cone, closed at its base and open at its narrow end to form the mouthpiece. In such a way the body of the pipe serves the function of providing a bowl for the holding of the cooling and cleaning liquid and additionally provides the function of the stem as shown in the Franks patent and other prior inventions. Both the collapsible telescopic body and the use of the single structure to perform two features provides an advantage over the prior art.

The invention may be described as a pipe for consumption of tobacco and other smokable substances comprising a collapsible, telescopic body in the shape of a truncated cone, closed at its base and open at its narrow end to form a mouthpiece, the sidewall of the body having a first carburetor hole and a second stem hole; a stem inserted into the body through said second hole and extending downwardly toward the base of the body; and a bowl attached to the exterior end of the stem for the holding of the smokable substance.

Although one of the unique features of the present device — the collapsible, telescopic body — has been shown in other devices, it has never been incorporated into a device that additionally utilizes a bowl for the holding of a cleaning and cooling liquid. These particular combined features are an advantage in the art as shown by the improved utility of such device in that it may be now collapsed, placed in the pocket, purse or suitcase of the user and taken with him wherever he might choose to go. As collapsed the device forms a compact piece, very conveniently fittable on the person of the user. Telescopic cigarette or cigar holding devices are shown in the King U.S. Pat. No. 645,399, however, this patent does not disclose a collapsible smoking device having a liquid holding bowl.

Figure 1:
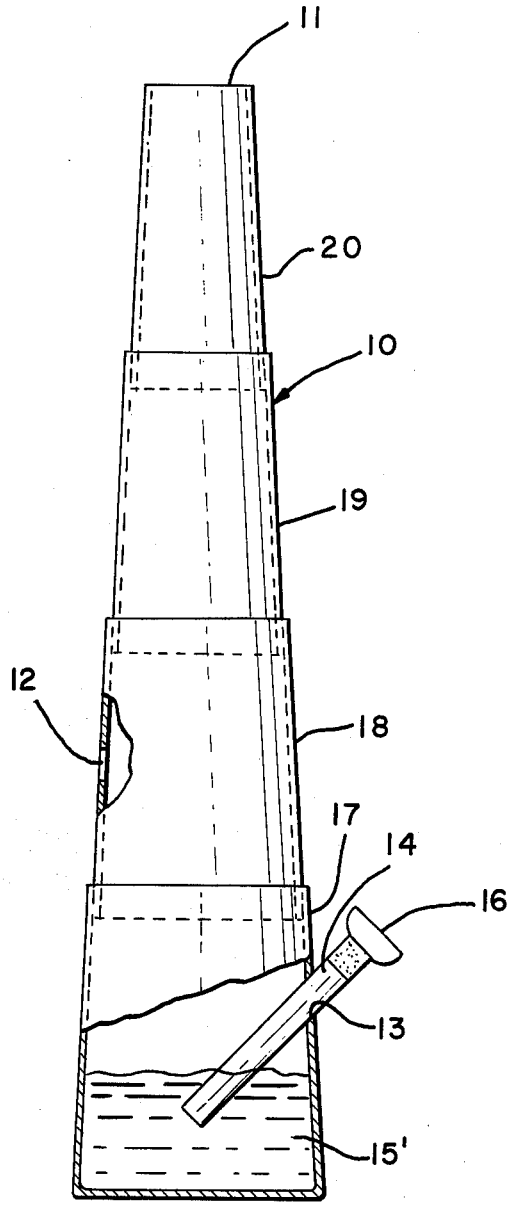
FIG. 1 is a side elevation of the collapsible, telescopic smoking device which is the subject of the present invention.

In FIG. 1 the collapsible telescopic body 10 is open at the top 11 to form a mouthpiece. The body 10 further has an opening 12 which provides the function of a carburetor hole. A second opening 13 is provided for the receiving of stem 14, which is fittable through the hole 13 of the side of the body 10 to impose downwardly into the device so that the draw end of the stem approaches the bottom of the pipe, which is adapted for the holding of a liquid 15. The stem may be adjustable through the hole 13 so that the bottom of the stem 14 may be set at different levels. The purpose of this is to maintain the draw end of the stem beneath the surface of the liquid 15. The liquid 15 may be any suitable liquid that will cool and/or clean the smoke which is drawn from the stem and into the pipe body. Thus, for example, although water is a preferred liquid, other suitable liquids would include ethanol and carbonated water and other like substances.

The stem 14 is equipped with a bowl 16 which is fitted on the end of the stem exterior of the pipe body. The bowl 16 holds the smokable substance and may be equipped with a screen to more securely hold the substance so that it will not be drawn down the stem into the liquid. However, in most cases, with most smokable substances a screen is not necessary and is not shown in the drawings.

Although tobacco is the preferred smokable substance, this invention is not limited to use with tobacco but encompasses use with any smokable substance such as other dried vegetable substances including, but not limited to, lettuce, leaves of certain trees and other materials that are well known to be smokable and similarly fit for human consumption.

The collapsible, telescopic body 10 comprises four flaring sections 17, 18, 19 and 20, which are fittable within one another. As shown in the drawing, FIG. 1, the sections may be extended and held by the pressure of the top lip of a lower section against the bottom edge of an upper section. Each section at its narrow end is slightly wider than the widest part of each lower section to limit the telescopic sliding. The pipe is usable in this extended position. Although the device in the drawing shows a telescopic body consisting of four inter-fittable sections, this invention encompasses any collapsible, telescopic body consisting of two or more inter-fittable parts.

Figure 2:
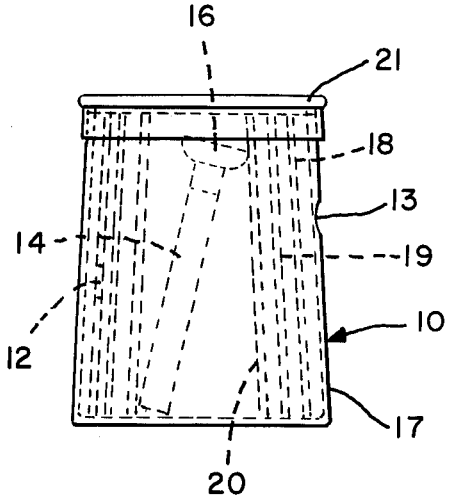
FIG. 2 is a side elevation of the above mentioned as collapsed and with lid.

FIG. 2 is a side elevation of the device of this invention as collapsed into a position suitable for transportation. In FIG. 2 the body has been collapsed so that the inter-fitting parts 17, 18, 19 and 20 are fitted within one another in a collapsed position. The stem and bowl 14 and 16 have been removed from the sidewall hole 13 and have been placed inside the body of the part 20. It is another feature of the present invention that in its collapsed position the stem and bowl may conveniently be fitted within the pipe as shown so that the entire device may be transported in a compact form. FIG. 2 additionally shows a cap 21 which may be provided for fitting over the top of the body as collapsed to form a compact body. The cap may be made of a hard plastic material or wood or metal or any other suitable material.

Figure 3:
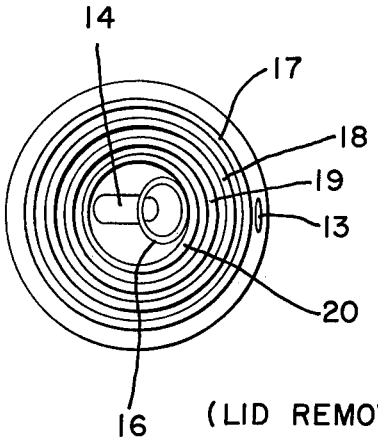
FIG. 3 is a top view of the collapsed device with lid removed.

FIG. 3 is a top view of the collapsed device with lid removed. FIG. 3 shows the convenient positioning of the stem and bowl within the collapsed bodies.

In operation the telescopic body 10 is extended so that the pieces 17, 18, 19 and 20 are held upright as already described. The lower body 17 of the pipe is filled with the liquid 15 to a suitable level and the stem 14 is fitted into the body through hole 13 and adjusted so that the bottom of said stem is beneath the surface of the liquid 15. The bowl 16 which may or may not be removable, if removable, is attached to the exterior end of the stem and is filled with tobacco or a like substance. The tobacco is fired and smoke is drawn down the stem and into the liquid 15 by drawing on the mouthpiece 11 and by suitably controlling the carburetor hole 12. The smoke is drawn through liquid and is thereby cooled and/or cleansed for the enjoyment of the user through mouthpiece opening 11. Opening 11 may be fitted with a piece made from plastic or other material and shaped to conform to the mouth of the user. Such piece is not shown in the drawings.

Although not shown in the drawings in another embodiment of the invention lower body 17 may be provided with a removable bottom cap to promote ease of cleaning the telescopic body. Of course, the cap would be constructed of any suitable material and would be so formed so as to provide a water tight fitting to the bottom of the piece 17. As to suitable materials for the device of this invention any formable material may be used such as steel, tin or aluminum, however, formable plastics are preferred materials and would include, but would not be limited to, polyacrylates and like plastic materials.

What is claimed is:

1. A pipe for consumption of tobacco and other smokable substances comprising: (1) a collapsible, telescopic body in the shape of a truncated cone, closed at its base and open at its narrow end to form a mouth piece, the sidewall of the body having a first carburetor hole and a second stem hole, said telescopic body comprising a series of truncated cone sections, each having a bottom portion having outside bottom edge diameter greater than the inside top lip diameter of the next succeeding larger lower cone so that the sections may be extended and held by the pressure of the top lip of a lower section against the bottom edge of an upper section; (2) a stem inserted into the body through the second hole said second hole being beveled downwardly from the outside to the inside of the said collapsible body and said stem having an outside diameter approximating the inner diameter of said second hole to fit firmly within said second hole at a plurality of positions and to extend downwardly toward the base of the said body; and (3) a bowl attached to the exterior end of the stem for the holding of the smokable substance.

2. The pipe of claim 1, wherein the collapsible, telescopic body comprises two or more flaring tubular sections adapted to slide telescopically upon one another and each section at its narrowest end being slightly wider than the widest part of each lower section to limit said telescopic sliding so that the body may be extended to form a truncated cone or collapsed with each part fitting within the other.

3. The pipe of claim 2 comprising four of said tubular sections.

4. The pipe of claim 1 wherein said stem is adjustable through said second stem hole so that its interior end within said body may lie immediately below liquid which may be held in said body.

5. The pipe of claim 1 being collapsed with each of said tubular sections lying within said next succeeding section and additionally comprising a cap over the top of said sections, said stem having a length no greater than the inside diagonal from top to bottom of the smallest and uppermost truncated cone section and fitting within said collapsed pipe.

* * * * *